US005875572A

United States Patent [19]

Redburn

[11] Patent Number: 5,875,572

[45] Date of Patent: Mar. 2, 1999

[54] TOOLLESS SHOE SPIKE

[75] Inventor: Loren Redburn, Weymouth, Mass.

[73] Assignee: E-Z Spike, Inc., Newton, Mass.

[21] Appl. No.: 881,998

[22] Filed: Mar. 20, 1997

[51] Int. Cl.[6] ..... A43C 15/00; A43B 5/00

[52] U.S. Cl. ..... 36/134; 36/67 D

[58] Field of Search ..... 36/67 D, 134, 36/67 R, 67 A

[56] References Cited

U.S. PATENT DOCUMENTS

| | | | |
|---|---|---|---|
| 1,658,050 | 2/1928 | Karlson et al. | 36/67 D |
| 4,414,763 | 11/1983 | Bente | 36/67 D |
| 4,492,047 | 1/1985 | Arff | 36/67 D |
| 4,633,600 | 1/1987 | Dassler et al. | 36/67 D |
| 4,723,366 | 2/1988 | Hagger . | |
| 5,259,129 | 11/1993 | Deacon et al. . | |
| 5,367,793 | 11/1994 | Deacon et al. . | |
| 5,475,937 | 12/1995 | Korsen | 36/67 D |

*Primary Examiner*—M. D. Patterson

*Attorney, Agent, or Firm*—Hedman, Gibson & Costigan, P.C.

[57] ABSTRACT

A toolless spike system for shoes wherein detents are used to retain and release, by snapping, clipping, etc., a spike member from a base member associated with the shoe.

10 Claims, 5 Drawing Sheets

TOOLLESS SHOE SPIKE

FIELD OF THE INVENTION

The present invention relates to replaceable spikes for shoes, particularly athletic shoes such as golf shoes and track and field shoes.

BACKGROUND OF THE INVENTION

Shoes having spikes, or cleats, thereon have long been known for athletic and field uses. It has also long been known that replacing spikes or cleats as they wear out is preferable to purchasing new shoes.

Additionally, replacement may be necessary if different types of spikes or cleats are used for different surfaces, etc. For example, "soft spikes" have been introduced as an alternative to metal spikes on golf shoes and are required at some golf courses. However, some golfers prefer metal spikes and use "soft spikes" only when required at a particular course. Similarly, track shoes have replaceable spikes where a longer spike is used on a cinder track and short spikes are required on permatrack.

Replacement of known spikes, however, requires a specialized tool to unscrew the spike from a base incorporated into the sole of the shoe. On golf shoes the tool is a spike wrench having two prongs which are inserted into corresponding holes on the spike and then turned to remove or tighten the spike. On track shoes the spike is similarly threaded into the base in the sole of the shoe, but the spike wrench has an opening comprising a truncated circle, having two flat portions on opposed sides to engage flat sides at the base of the spike. In either event, without a specialized tool removal and replacement of the spikes from the shoe cannot be achieved.

It is therefore an object of the present invention to provide a spike system for shoes which does not require a specialized tool for removal and replacement of the spikes.

It is a further object of this invention to provide a spike system which allows for the quick, manual removal and replacement of spikes.

SUMMARY OF THE INVENTION

These and other objects are achieved by the present invention which provides a replaceable spike system for shoes comprising a spike member for releasable attachment to a cooperating base member, said system comprising detent means for retaining and releasing said spike member from said base member, said spike member being released and replaced by manual activation of the detent means.

The detent means can be associated with either the spike member or the base member. Locking means are associated with the member cooperating with the member having the detent means associated therewith. The locking means may be an aperture such as a slot into which the detent means fits snugly or an indentation, shelf or stop which prevents release of the spike member.

The spike member preferably has a key cooperating with a keyway on the base member (which may include the shoe sole itself) for proper alignment of the spike member on the base member. The key can include a threaded path which cooperates with a thread on the cooperating member, at the end of which the detent means engages the locking means.

When the user wishes to release a spike he manually activates the detent means, preferably by manually depressing the detent means or an actuator associated therewith.

This allows the detent means to overcome the locking means and the user can pull out the spike. Depending on the design of the members, the spike member is lifted straight out or is twisted while being lifted.

Most preferably, the base member is replaceable on the shoe. Additionally, the shoe sole may have depressions in the area of the detent means or actuator to allow a user's fingers to actuate the detent means.

BRIEF DESCRIPTION OF THE DRAWINGS

The following drawings, wherein like reference characters represent like parts, are presented for illustration purposes only, without whatsoever limiting the invention claimed herein.

DETAILED DESCRIPTION OF THE PREFERRED EMBODIMENT

Figure 1:
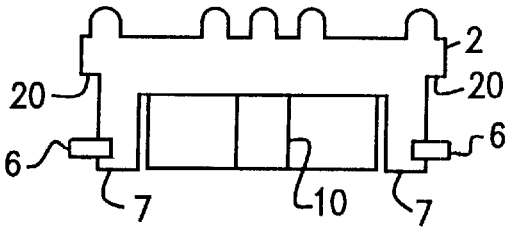
FIG. 1 is an elevation of the spike member of the preferred embodiment or the present invention.
Figure 1A:
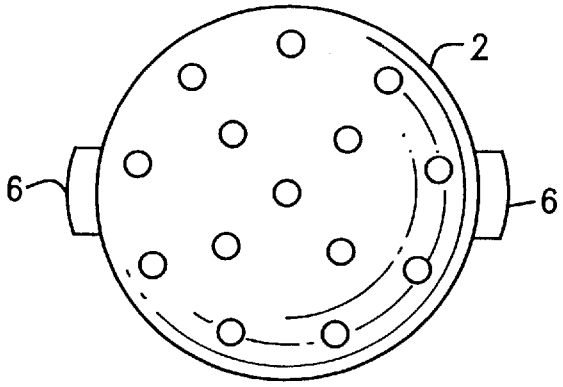
FIG. 1A is a plan view of the spike member of FIG. 1.

The present invention of a replaceable spike system for shoes comprises a spike member 2 and a base member 4. The spike member 2 is held in place on the base member 4 by detent means 6 which can be manually manipulated (without the use of tools) to release the spike member 2 from the base member 4. The detent means 6 is capable of retractable movement by either being associated with a spring leg 7, spring mechanism, or the like.

The detent means 6 engage locking means 8 to lock the spike member 2 on the base member 4. Preferably, the locking means 8 is a slot into which the detent means 6 is accepted. Alternatively, the locking means can include a shelf or stop 8*a* so that when the detent means 6 passes the shelf or stop 8*a*, the detent means 6 engage the shelf or stop 8*a*.

Preferably, as shown in FIGS. 1 and 2A and 4 and 5A, the spike member 2 and base member 4 have a cooperating key 10 and keyway 12 for proper alignment of the spike member 2 on the base member 4. This key arrangement provides that the detent means 6 is in the proper plane to engage the retention means 8. The key arrangement can also comprise a threaded engagement between the members 2 and 4 wherein when the spike member 2 is drawn down to the proper position, the detent means 6 engages the locking means 8.

Additionally, it is preferred that the base member 4 is replaceable should it fail. It is contemplated that replacement of the base member 4 on the shoe sole is effected by semi permanent connection means 14, such as a threaded post 16 and nut 18. Other connection means 14 can be used, as long as it provides a solid attachment of the base member 4 to the shoe. For golf shoes a nut 18 utilizing the two hole engagement by a two prong spike tool currently used for attachment of spikes may be suitable. Alternatively, the base member can be integral with the shoe sole and not replaceable.

Figure 2:
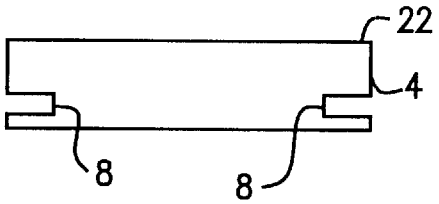
FIG. 2 is an elevation of the base member of the preferred embodiment of the present invention which cooperates with the spike member shown in FIG. 1.
Figure 2A:
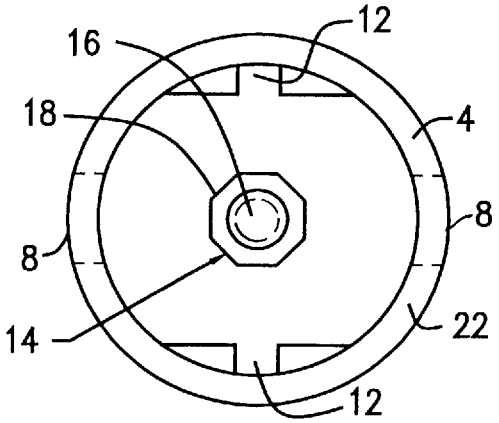
FIG. 2A is a plan view of the base member of FIG. 2.

In the most preferred embodiment, shown in FIGS. 1–2A, the spike member 2 has detent means 6 positioned on two spring legs 7. Two keys 10 are disposed 90° from the detent means 6 to align the detent means 6 with the locking means 8 and provide additional support to the spike member 2 when inserted into the base member 4.

The base member 4 has locking means 8 comprising slots into which the detent means 6 intimately fit. The base member 4 has an aperture (not shown) at the center of the bottom plate through which a threaded post 16 from the shoe sole extends. A nut 18 is then tightened on the threaded post 16 to semi-permanently secure the base member 4 to the shoe. Although permanent attachment of the base member 4 to the shoe sole is possible, with rivets or integral formation with the sole, a semi-permanent, removable attachment is preferred if failure of the base member 4 is a concern.

The keys 10 mate with keyways 12 and the spike member 2 is pushed down onto the base member 4. The detent means 6 are initially depressed to get over the edge 22 of the base member 4 and the spike member 2 is then pushed downward until the detent means 6 snap or clip into the slots 8 on the base member 4. There is preferably a slight overhang 20 of the top of the spike member 2 to cover the top edge 22 of the base member 4 when installed thereon.

Figure 3:
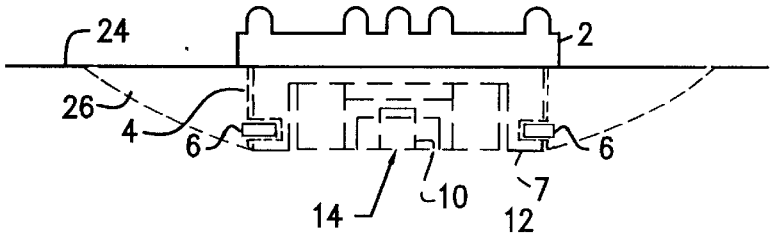
FIG. 3 is an elevation of the preferred spike system of the present invention on a shoe.
Figure 3A:
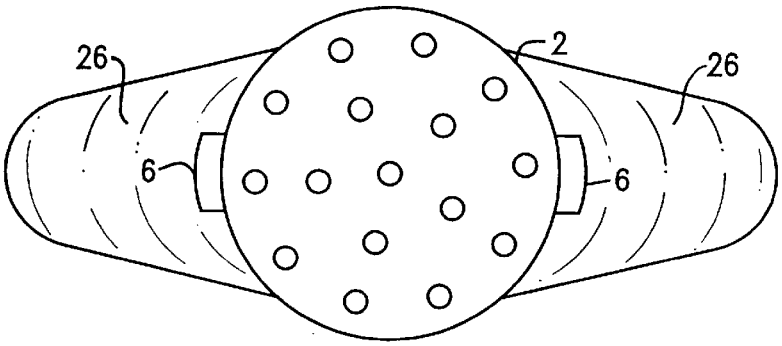
FIG. 3A is a plan view of the preferred spike system of FIG. 3 on a shoe.

FIGS. 3 and 3A show the preferred system on a shoe sole 24. In this environment it is contemplated that the shoe sole 24 have recesses 26 in the area of the detents 6 to allow a user's fingers to actuate the detent means 6.

For stability, the underside of the spike member 2 which fits into the hash member 4 is preferably substantially solid, for substantial contact with the base member 4, save possibly an area in which the connection means 14 occupy and room for the throw of the spring leg 7.

Figure 4:
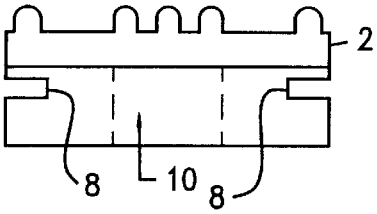
FIG. 4 is an elevation of an alternative spike member of the present invention.
Figure 5:
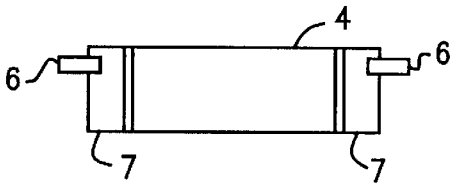
FIG. 5 is an elevation of the base member which cooperates with the spike member shown in FIG. 4.
Figure 5A:
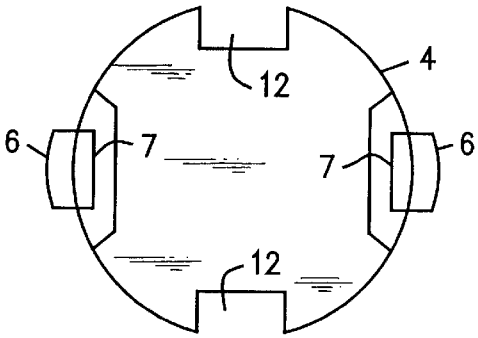
FIG. 5A is a plan view of the base member shown in FIG. 5.

A preferred alternative embodiment is shown in FIGS. 4–5A. Basically, this embodiment is the mirror image of the above embodiment, with the spike member 2 fitting over the base member 4 rather than within the base member 4. As such, in this embodiment the detent means 6 are associated with the base member 4 and the locking means 8 are associated with the spike member 2. Here, the base member 4 is substantially solid to provide support, save room for connection means 14 and throw of the spring leg 7. Connection means 14 are not shown in this embodiment, but such means 14 similar to those above described are contemplated as preferred. All other elements are generally as described above, including the possible use of a threaded keyway for intimate contact of the spike member 2 and base member 4.

Figure 6:
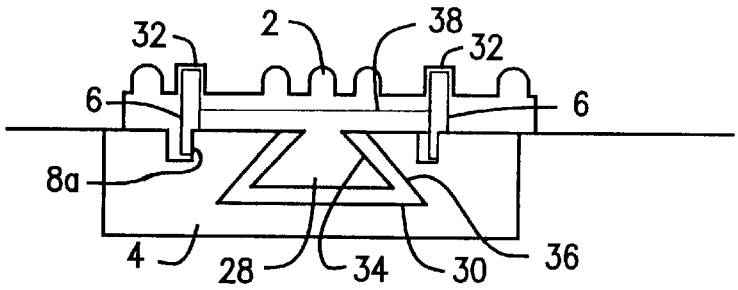
FIG. 6 is a cross sectional elevation of an alternative spike system of the present invention.
Figure 6A:
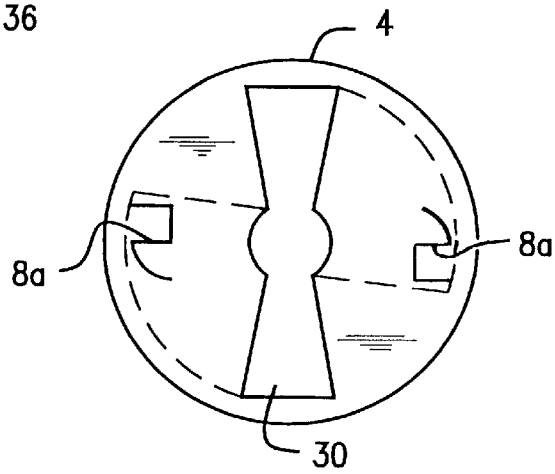
FIG. 6A is a plan view of the base member which cooperates with the spike member shown in FIG. 6.

Another embodiment of the present invention is shown in FIGS. 6 and 6A. This embodiment utilizes a foot 28 which fits within an opening 30 in the base member 4. Detent means 6 further comprising an actuator 32 for manual engagement by the user to release the detent means 6 are associated with the spike member. In this embodiment, the foot 28 has the shape of the opening 30 (acting also as key 10 and keyway 12) and has cammed surfaces 34 which engage cooperating cammed surfaces 36 in the base member 4. The foot 28 is inserted into the opening 30 and is twisted to engage the cammed surfaces 34 and 36 and draw the spike member 2 down onto the base member 4. When the spike member 2 is twisted to its proper position, the detent means 6 engages a shelf or stop 8*a*.

For removal, a user engages the actuators 32 and presses them together, pivoting the detent means about a pivot bar 38 so that the detent means 6 moves outward beyond the reach of the shelf 8*a*. With the actuators 32 squeezed together the spike member 2 is twisted off and pulled from the base member 4. In this embodiment it is contemplated that while the detent means 6 is a durable rigid structure, the user engaged portion of the actuators 32 is coated with a material uniformly with the outer portion of the spike member 2, i.e. rubber, polymer, etc., as currently used for "soft spikes".

Also available with the embodiment of FIGS. 6 and 6A is the use of detent means 6/locking means 8 associated with the sides of the spike member 2. This embodiment would be similar to either the embodiment of FIGS. 1–2A or the embodiment of FIGS. 4–5A, and most preferably FIGS. 4–5A.

Release of the spike member 2 of this embodiment is achieved by depression of the detent means 6 on the sides and twisting the spike member 2 so the cammed surface 34 of the foot 28 disengages the surface 36 of the opening 30 and is pulled therefrom.

Figure 7:
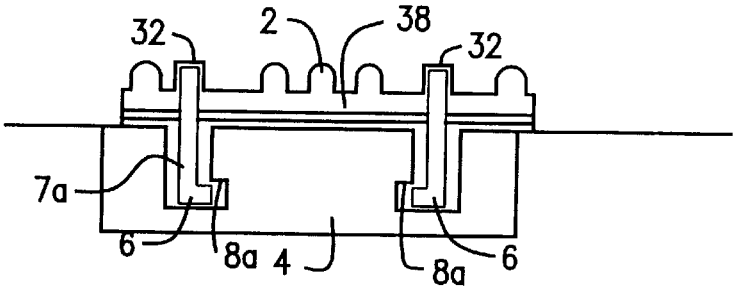
FIG. 7 is an elevation of another alternative spike system of the present invention.
Figure 7A:
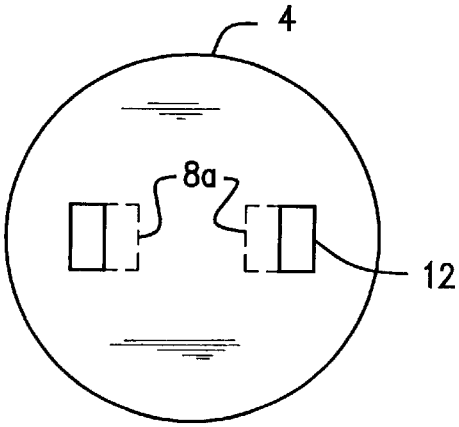
FIG. 7A is a plan view of the base member which cooperates with the spike member shown in FIG. 7.

A further alternative, shown in FIGS. 7 and 7A utilizes detent means 6 having a cooperating spring leg 7*a* and an actuator 32. In this embodiment, the detent means 6 (acting as a key 10) is inserted into the keyway 12 on the base member 4. The detent means 6 rides against the wall of the keyway 12 until the spike member is fully inserted, at which point the detent means 6 clip into and engage shelves 8*a* at the bottom of the keyway 12.

To release the spike member 2 from the base member 4, a user squeezes the actuators 32 together to pivot the detent means 6 about a pivot 32 until the detent means 6 disengages the shelves 8*a*. The spike member 2 is then pulled from the base member 4.

Figure 8:
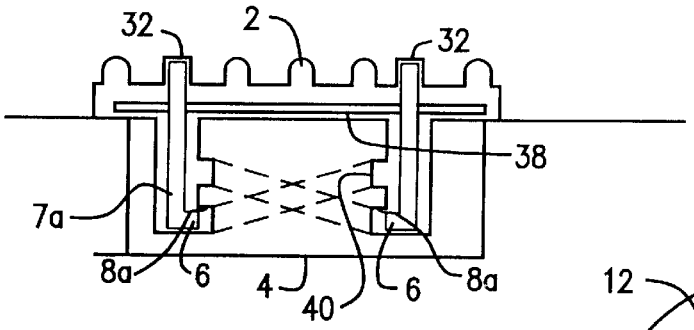
FIG. 8 is an elevation of a further alternative spike system of the present invention.
Figure 8A:
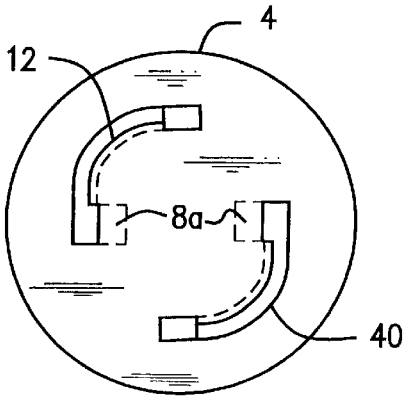
FIG. 8A is a plan view of the base member which cooperates with the spike member shown in FIG. 8.
Figure 9:
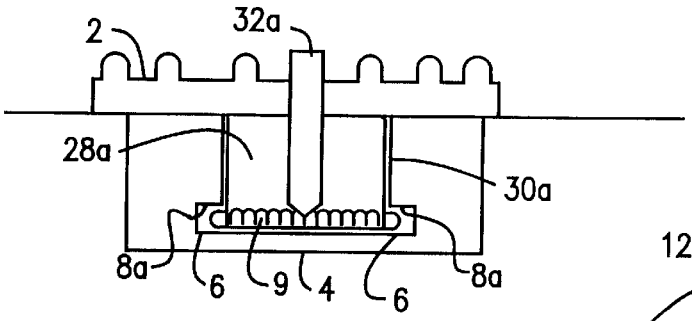
FIG. 9 is an elevation of an additional alternative spike system of the present invention.
Figure 9A:
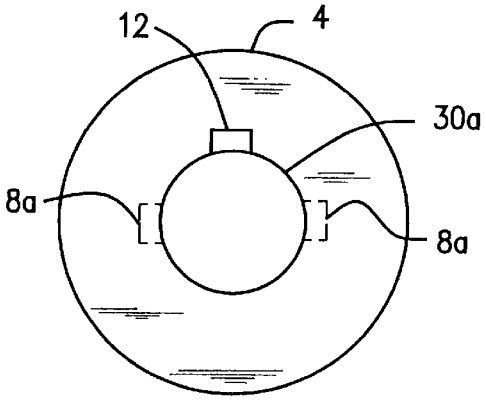
FIG. 9A is a plan view of the base member which cooperates with the spike member shown in FIG. 9.
Figure 10:
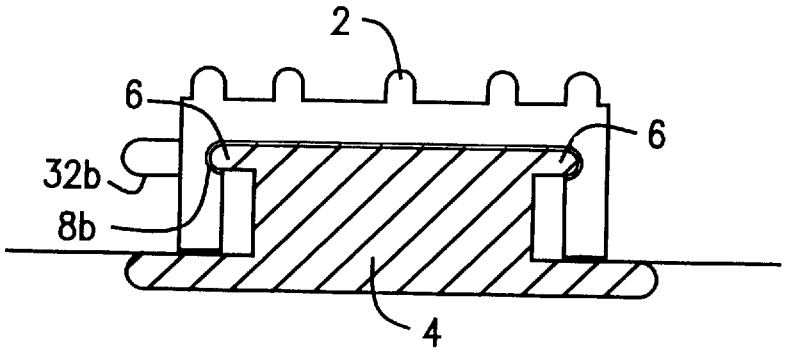
FIG. 10 is an elevation in cross section of a further alternative of the present invention.

A similar alternative is shown in FIGS. 8 and 8A wherein the keyway 12 is formed of a radial pathway 40 terminating at shelves 8*a*. In this embodiment, the spike member 2 is twisted and the detent means 6 draw the spike member 2 down onto the base member 4. When the spike member 2 in fully inserted, the detent means 6 engage the shelves 8*a* to lock the spike member 2 in place.

To release, a user squeezes the actuators 32 together to release the detent means from the shelf 8*a* and twists the spike member 2 up and off of the base member 4.

Another alternative of the present invention utilizes a spring 9 with an actuator comprising a plunger 32*a* to activate the release of the detent means 6. In this embodiment the foot 28*a* is a keyed member shown as a keyed cylinder, but can be any shape, which slides into an opening 30*a* with a shelf 8*a* at the bottom of the opening 30*a*.

To release the spike member 2, the user pulls up on the spring loaded plunger 32*a* and thus retracts the detent means 6 from the shelf 8*a*, allowing the spike member 2 to be pulled from the base member 4.

In a still further embodiment, the base member 4 is a solid piece and has detent means 6 onto which the locking means 8*b* of spike member 2 snaps. The actuator 32*b* can be manually lifted to release the detent means 6 from the locking means 8. In the preferred manufacture of this embodiment, the base member 4 is made of a very durable material, such as stainless steel, and the interior of the spike member 2 may be brass so that failure is dealt with merely by replacing the spike member 2.

Obvious variations to the above description will make themselves apparent to those skilled in the art reading this disclosure. All such variations are intended to fall within the spirit and scope of the present invention, limited only by the appended claims.

I claim:

1. A replaceable spike system for shoes comprising a spike member and a base member, said spike member being adapted for releasable attachment to said base member, said system comprising detent means for retaining and releasing said spike member from said base member, said spike member being released from said base member by manual activation of the detent means.

2. The system of claim 1 wherein the detent means is located on the spike member.

3. The system of claim 1 wherein the detent means is located on the base member.

4. The system of claim 1 wherein the detent means engages locking means on the member cooperating with the member having the detent means associated therewith.

5. The system of claim 4 wherein the locking means is an aperture.

6. The system of claim 4 wherein the locking means is taken from the group consisting of a shelf, a stop or a recess.

7. The system of claim 1 wherein the base member is integral with the sole of the shoe.

8. A replaceable spike member for a shoe comprising locking means for engaging detent means associated with said shoe, said locking means being adapted for engagement with said detent means, wherein said detent means is manually activated by the user for release of the spike member from the shoe.

9. A replaceable spike member for a shoe comprising detent means for engaging locking means associated with said shoe, said detent means being adapted for manual activation by the user to release the spike member from the shoe.

10. A method for releasing a spike member from a shoe, said shoe having a base member thereon, consisting essentially of the steps of manually activating detent means and removing the spike member from the base member.

* * * * *